United States Patent [19]

Edwards

[11] 4,020,549

[45] May 3, 1977

[54] HAIR CUTTER COMB

[76] Inventor: Syd Edwards, 141 Grand View, Leucadia, Calif. 92025

[22] Filed: Nov. 5, 1975

[21] Appl. No.: 628,987

[52] U.S. Cl. ..... 30/30; 30/140; 30/233.5

[51] Int. Cl.[2] ..... B26B 21/12; B26B 19/38

[58] Field of Search ..... 30/30, 34 R, 140, 195, 30/208, 209, 210, 215, 216, 218, 220, 233.5

[56] References Cited

UNITED STATES PATENTS

| | | | |
|---|---|---|---|
| 600,513 | 3/1898 | Clark | 30/215 X |
| 1,144,542 | 6/1915 | Hammel | 30/208 |
| 2,824,566 | 2/1958 | Pileggi | 30/34 R X |
| 3,711,948 | 1/1973 | Ford | 30/233.5 X |

FOREIGN PATENTS OR APPLICATIONS

| | | | |
|---|---|---|---|
| 398,969 | 9/1933 | United Kingdom | 30/30 |

*Primary Examiner*—Gary L. Smith
*Attorney, Agent, or Firm*—Fulwider Patton Rieber Lee & Utecht

[57] ABSTRACT

There is disclosed a hair cutter comb including a plurality of parallel spaced apart metallic comb teeth formed along one edge of their one sides with cutting edges. A cutter mechanism overlies such one side and includes a plurality of blade members formed on their respective one extremities with blades having one edge thereof defining blade edges. Such blade edges are mounted intermediately on pivot pins carried by the comb back to cause such blades to pivot outwardly about such pivot pins in a rotary path to pass into cutting engagement with the respective cutting edges. The extremities of the blade members opposite the blades themselves are formed with lever arms which are individually pivotally connected to a reciprocatory actuator mounted on the comb back whereby reciprocation of such actuator causes the blades to move from their retracted positions extending parallel to the comb back outwardly to their extended position parallel of the teeth to thereby pass into cutting engagement with the respective cutting edges of the teeth to sever hair strands between such blade edges and cutting edges.

10 Claims, 7 Drawing Figures

HAIR CUTTER COMB

BACKGROUND OF THE INVENTION

1. Field of the Invention

The hair cutter comb of the present invention relates to a hair care device which may be utilized in cutting and styling hair.

2. Description of the Prior Art

The art of hair cutting has evolved only insofar as hair cutting instruments have been refined. Few innovations have occured in the basic method of cutting hair and the evolvement of better methods has been hampered by failure to evolve better instruments.

Under present day methods, the hair is raised with one hand and is cut by an implement held in the opposite hand. Raised away from the scalp, the angle at which the hair is elevated determines the effect and style of the cut.

This invention is a departure from the lengthy tradition of hair cutting. It is designed for one-handed use, and thereby makes easy a previously difficult task. Novice and professional alike may cut their own hair with less effort and in less time than as if they were to use the traditional method. Specifically, this hair cutting invention produces a blunt cut that is obtained from the downward-diagonal movement of cutting implements mounted within its structure. A blunt cut differs from a sliced cut in that the former is scissor-like and the latter produces an effect similar to shaving.

With the advent of present day hair styles dictating a blown and scissors cut look in har grooming, numerous different methods have been proposed for cutting hair. The cutting of hair by blunt scissors has gained increasing popularity in order to acquire the many different styles. However, such scissor cutting is inconvenient and severely restricts the style that may be produced. Further, different types of home instruments have been proposed for cutting hair by the do-it-yourselfer, but these devices are generally inconvenient to use and do not provide a satisfactory cut for use by a professional hairdresser.

SUMMARY OF THE INVENTION

The hair cutter comb of the present invention is characterized by a comb incorporating a plurality of coextensive spaced apart teeth formed along one edge of their respective one sides with sharp, hair-cutting edges. A cutter mechanism overlies such one sides of the comb and includes a plurality of blade members which are medially pivotally mounted from the comb and formed on one extremities with blades which sweep outwardly over the teeth in a rotary path and are formed on their leading edges with blade edges to cooperate with the various cutting edges encountered to sever hair strands trapped therebetween. The opposite extremities of the blade members are in the form of lever arms which are pivotally connected to a rigid actuator bar which reciprocates back and forth along the comb bact to correspondingly reciprocate the blades about their pivot points. Preferably, both sides of the teeth are formed along their respective one edges with cutting edges and blades are disposed in staggered relationship on opposite sides thereof for actuation by the actuator to pass into cutting engagement with the respective cutting edges. A motor and elements for the internal generation of heat may be added to cause the scythe-like effect of the cutting blades to be accompanied with extreme heat to simultaneously cut and fuse the split and damaged hair ends.

The objects and advantages of the present invention will be apparent from a consideration of the following detailed description when taken in conjunction with the accompanying drawings.

DESCRIPTION OF THE PREFERRED EMBODIMENTS

Figure 2:
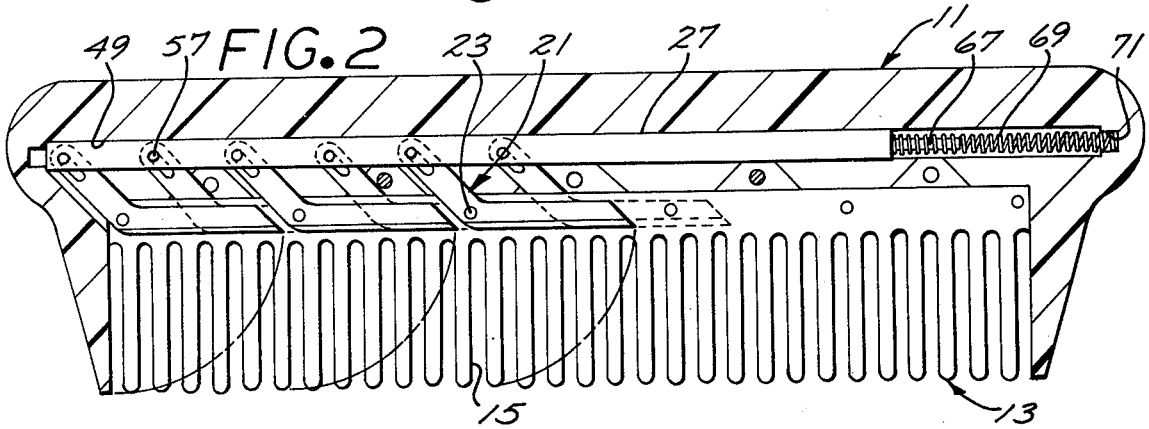
FIG. 2 is a longitudinal sectional view, in enlarged scale, taken through the hair cutter comb shown in FIG. 1.
Figure 6:
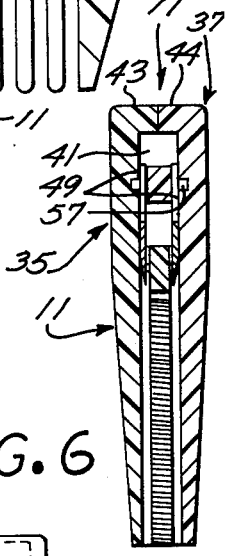
FIG. 6 is a transverse sectional view, in enlarged scale, taken along the line 6—6 of FIG. 1.

Referring to FIGS. 2 and 6, the hair cutter comb of the present invention includes, generally, a cutting comb in the form of a central core 11 incorporating a plurality of parallel spaced apart metallic teeth 13, such teeth being formed along their respective opposite sides with cutting edges 15 which face to the right as viewed in FIG. 2. Mounted in staggered relationship on opposite sides of the comb core 11 are blade members, generally designated 21, which pivot about medial pivot pins 23 and are formed on their one extremities with blade 24 having one edge defining leading blade edges 25 such that clockwise rotation of the blade members about their pivot pins 23 causes such blade edges 25 to swing progressively into cutting engagement with the various teeth cutting edges 15 over which they pass. A rigid actuator bar 27 is mounted on the comb core 11 and coupled with the blade members 21 for rotation of such blade members upon reciprocation thereof. Consequently, the user may shift the actuator bar 27 to the left as viewed in FIG. 2 to retract the blades 24 and then pass the teeth 13 through the hair to bring such teeth to rest at the length of hair desired. The actuator bar 27 will then be drawn to the right as viewed in FIG. 2, thus rotating such blades 24 about their pivot points to cause the blade edges 25 to progressively sever the hair strands against the cooperating cutting edges 15 of the various teeth 13 over which such blades sweep.

While the comb core 11 may take many forms, in the preferred embodiment the cutting teeth 13 project from an integral back frame 33 (FIG. 3) to form the cutting comb core 11. Still referring to FIG. 3, the teeth 13 are generally square-in-cross-section and have both righthand edges thereof formed with sharp corners to define the cutting edges 15 with the lefthand edges of such teeth being somewhat rounded.

The metallic comb core 11 is encased in two plastic comb housing halves, generally designated 35 and 37, with each such half being the miror image of the other and being formed with parallel teeth 39 which overlie and are aligned with the respective cutting teeth 13. The housing teeth 39 are somewhat wider than the cutting teeth 15 to thus overlie the opposite edges of such cutting teeth thereby drawing the hair strands away from cutting teeth edges 15 during the time that the comb is being passed through the hair, thus protecting the hair itself from damage by such edges. Referring to FIG. 6, the marginal top edges of the comb housings 35 and 37 are turned inwardly towards one another to form abutting flanges 43 and 45 and are likewise formed along their opposite ends with similar marginal edges to thus define a central cavity 41 for receiving the cutting core 11. The cutting core 11 is carried from the housings 35 and 37 by means of mounting pins 45 and such housings are formed above the core 11 with longitudinally extending, inwardly opening confronting channels forming tracks 49 which slidably mount the actuator bar 27.

The upper ends of the blade members 21 are formed with lever arms 53 which conveniently project at an angle of approximately 45° to the longitudinal axis of the blades 24 and are formed with elongated articulation slots 55 which receive respective coupling pins 57 projecting through the actuator bar 27 and received in their opposite ends within tracks 49 formed in the housings 35 and 37.

Figure 3:
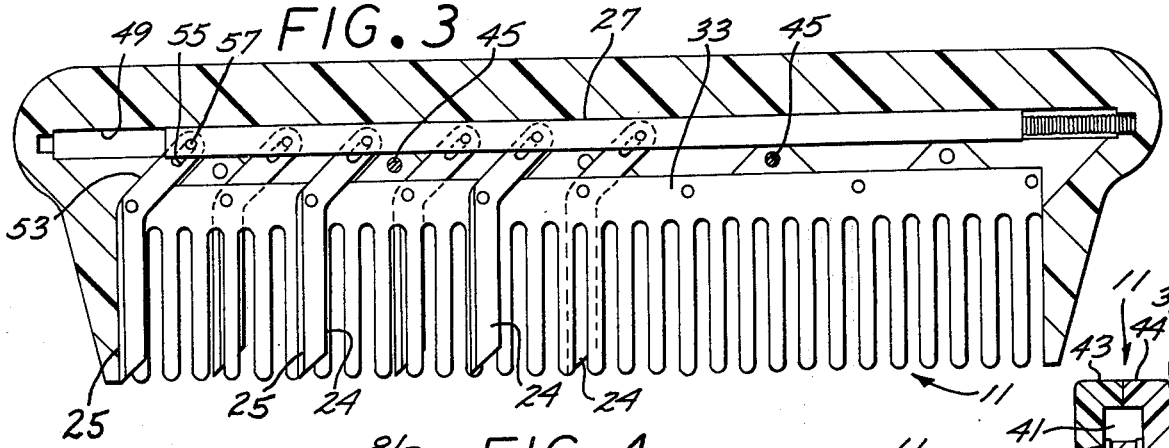
FIG. 3 is a longitudinal sectional view similar to FIG. 2, but showing the blades in their extended positions.

Referring to FIG. 3, the actuator bar 27 is formed on its righthand end with an elongated stem 67 over which is telescoped one end of a coil compression spring 69, the opposite end of such spring being received in a complementary bore 71 formed in the housings 35 and 37 at the end of the channel 49 to thereby cause such spring to normally bias such actuator bar to the left.

Figure 1:
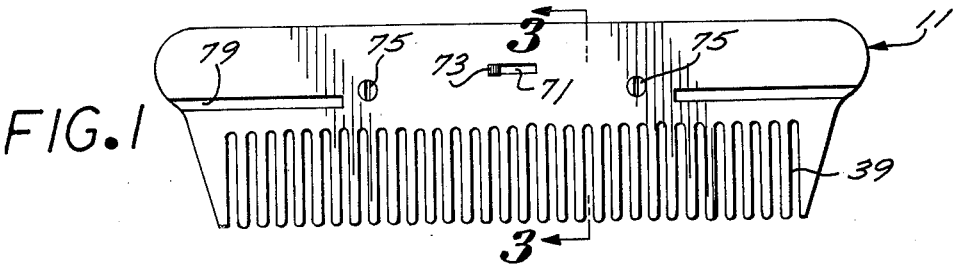
FIG. 1 is a side view of a hair cutter comb embodying the present invention.

Referring to FIG. 1, the housing half 35 is formed intermediately with a through-slot 71 having an actuator button 73 projecting from one side of the actuator bar 27 received therethrough for engagement by the operator's thumb.

Figure 4:
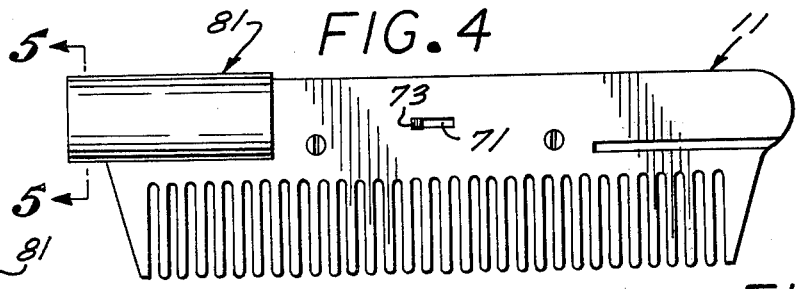
FIG. 4 is a side view of a modification of the hair cutter comb shown in FIG. 1.
Figure 5:
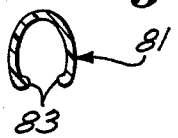
FIG. 5 is a partial transverse sectional view taken along the line 5—5 of FIG. 4.

Still referring to FIG. 1, the comb housing halves 35 and 37 are connected together by means of assembly screws 75 and are formed at their opposite extremities with elongated outwardly opening slots 79 which may selectively receive a slit forming cover, generally designated 81 (FIGS. 4 and 5) The forming cover 81 is somewhat oval-in-cross-section and is slit along one side and formed with inwardly projecting confronting flanges 83 which are slidably received longitudinally inwardly from the ends of the respective slots 79 to mount such rolls from the comb itself.

In operation, the hair cutter comb of the present invention may conveniently be manipulated by one hand while the other hand is otherwise occupied or even impaired. The comb may be utilized by sweeping the housing teeth 39 through the hair strands, thus causing the leading teeth thereof to part the hair strands and direct such hair strands through the space formed between such teeth 39 and guarding the hair strands from damage by the sharp edges 15 of the core teeth 13. The hair strands may thus be conveniently lifted to an elevated distance so the hairdresser can accurately observe the length of such strands and predict the actual length thereof after cutting. With the comb thus positioned at the length of strand desired, the hairdresser may engage the thumb button 73 and urge such button to the right, as viewed in FIGS. 1–3, thereby drawing the actuator bar 27 to the right, thus pivoting the blade members 21 clockwise about their pivot pins 23 causing the lower extremities of such blade members to pivot to sweep downwardly and to the left over the adjacent cutting edges 15 of the core teeth 13, thereby causing the blade edges 15 to engage the hair strands trapped in the spacing between the core teeth 13 to sever such hair strands in sharp and blunt ends to obtain the desired length and appearance for the strands so severed.

Referring to FIG. 2, it will be appreciated that as the blade members 21 on the opposite sides of the cutting core 31 sweep downwardly from their staggered relationship such members will, in combination, cover the entire array of core teeth 13 throughout the lefthand half of the comb to thereby assure severance of all hair strands projecting between the teeth 39 and 13. The comb is then drawn free of the hair and the button 73 released to enable the compression springs 69 to urge the actuator bar 27 to the left, thus rotating the blade members 21 counterclockwise about their pivot points 23 thus retracting such blade members to their retracted position shown in FIG. 2 in preparation for the next sweep through the hair.

It will be appreciated that if desirable, the hairdresser may conveniently mount the forming cover 81 on the comb housing by merely inserting the mounting flanges 83 slidably inwardly from the ends of the mounting slots 79 to cause such roller to be held frictionally in position. Thus, during styling of the hair, the hair itself may be drawn over such cover 81 to facilitate the hair styling.

Figure 7:
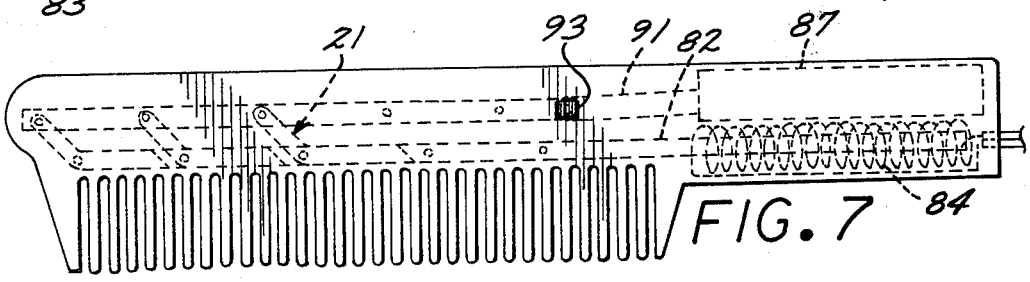
FIG. 7 is a side view of a second embodiment of the hair cutter comb of the present invention.

The hair cutter comb shown in FIG. 7 is substantially the same as that shown in FIGS. 1–6, except that a heat motor 84 is mounted thereon for heating the core teeth 13. A heat, transfer bar 82 is mounted on the housing itself with one end thereof in heat-transfer relationship with the heat motor 84 and the opposite end contacting the heat conductive comb core 11 to thus heat such core and to likewise heat the blades 24 thereby maintaining the core teeth 13 at an elevated temperature to thereby sear the hair ends as they are severed to thus inhibit splitting and other damage resulting from cutting of the strands themselves.

A drive motor 87 is also mounted in the handle of the comb shown in FIG. 7 and is inductively coupled with the ferromagnetic actuator bar 91 with power thereto being controlled by a control switch 93 whereby the actuator bar is drawn to the left to actuate the blade members 21 by manipulating the switch 93 to close the circuit to the drive motor 87 thus drawing the actuator bar to the left with respect to such motor and rotating the blades 24 clockwise to perform the hair cutting function.

From the foregoing, it will be apparent that the hair cutter comb of the present invention provides a convenient and effective means for cutting hair while only using one hand and enabling the hairdresser to elevate the hair during cutting thereof in order that he might have the best opportunity to observe the hair during the cutting procedure and accurately control the length of hair cut, as well as slope, taper and form layers of hair in its final appearance. Thus, not only does the hair cutter comb of the present invention, enable persons with impaired use of one arm to actually perform hair styling activities, but it enables hairdressers to leave one hand free while performing the hairdressing functions and enables better performance of the actual task of cutting and shaping the hair itself.

Various modifications and changes may be made with regard to the foregoing detailed description without departing from the spirit of the invention.

I claim:

1. A hair cutter comb comprising:

a comb including a stationary cutter formed with an elongated back having parallel cutting teeth projecting from one side thereof and formed on one side along their respective one edges with cutting edges;

a blade mechanism on said one side and including a plurality of blade members pivotally mounted along their medial portions from said back, formed on their respective one extremities with blades having blade edges formed along one side thereof and on their opposite extremities with lever arms and being rotatable from respective retracted positions projecting coextensive with said back to shield said edges from hair passing between said cutting teeth to sweep over the respective underlying cutting teeth to respective extended positions projecting coextensive with said cutting teeth; and an actuator bar carried from said back for reciprocatory travel therealong and pivotally connected with said individual lever arms said actuator when shifted in one direction rotates said blade members to their retracted positions with said edges shielded by said back and when shifted in the opposite of said one direction pivots said blade members to their extended position to sweep said blades across the underlying blade edges to progressively sever the strands of hair caught between said blade and cutting edges.

2. A hair cutter comb as set forth in claim 1 that includes:

a housing including shield teeth projecting along opposite sides and in alignment with said cutting teeth to direct hair strands into the spaces formed between said cutting teeth.

3. A hair cutter comb as set forth in claim 1 wherein:

said lever arms are formed with longitudinal slots, said actuator includes a bar mounted from said comb for linear translation with respect thereto and coupled to said respective lever arms by slider pins received in said respective slots.

4. A hair cutter comb as set forth in claim 1 that includes:

a housing covering said cutter;

a roller formed with a curved periphery for drawing hair thereover; and mounting means removably mounting said roller from said housing.

5. A hair cutter comb as set forth in claim 1 that includes:

bias means mounted on said comb and biasing said actuator to urge said blades to their retracted positions.

6. A hair cutter comb as set forth in claim 1 wherein:

said cutting teeth are formed on their respective sides opposite said one sides with respective second cutting edges; and said blade mechanism includes a plurality of blade members pivotally mounted medially on said sides opposite said one sides of said cutter and formed on their respective one extremities with blades pivotable from retracted positions parallel of said back to extended positions parallel of said cutting teeth and formed along their leading edges with blade edges engagable with said cutting edges during extension of said blades, said blade members being formed on their extremities opposite said one extremities with lever arms pivotally coupled to said actuator for extension thereof upon shifting of said actuator.

7. A hair cutter comb as set forth in claim 1 wherein:

said actuator includes an elongated rigid bar including a pusher button projecting transversely therefrom for pushing by the operator's thumb.

8. A hair cutter comb as set forth in claim 1 that includes:

a pair of housing halves positioned on opposite sides of said cutter and formed with top and end inwardly projecting complementary peripheral flanges abutting one another at the inner ends to define a central elongated cavity receiving said cutter and extending beyond the back thereof to form an actuator cavity receiving said actuator, said actuator cavity being formed on its opposite sides with longitudinal confronting slots defining tracks;

said lever arms are formed with elongated slots; and said actuator includes a rigid bar and slider pins projecting through said bar and through said respective blade slota and projecting from the opposite sides thereof to be recieved in said tracks.

9. A hair cutter comb as set forth in claim 1 wherein:

said cutter is constructed of heat conductive material and includes a heat motor and heat conduction means coupled between said motor and cutter for transferring heat to said cutter.

10. A hair cutter comb as set forth in claim 1 that includes:

electrical drive motor means coupled with said actuator bar for driving said blade mechansim.

* * * * *